US005181334A

United States Patent [19]

Mima

[11] Patent Number: 5,181,334

[45] Date of Patent: Jan. 26, 1993

[54] DISPLAY APPARATUS

[75] Inventor: Yoshinobu Mima, Hyogo, Japan

[73] Assignee: Japan Tobacco Inc., Tokyo, Japan

[21] Appl. No.: 884,896

[22] Filed: May 18, 1992

Related U.S. Application Data

[63] Continuation of Ser. No. 653,519, Feb. 11, 1991, abandoned.

[30] Foreign Application Priority Data

Mar. 5, 1990 [JP] Japan ..... 2-51763

[51] Int. Cl.[5] ..... G09F 11/12

[52] U.S. Cl. ..... 40/524; 40/446

[58] Field of Search ..... 40/524, 525, 526, 472, 40/473, 475, 527, 528, 446

[56] References Cited

U.S. PATENT DOCUMENTS

| | | | |
|---|---|---|---|
| 615,358 | 12/1898 | Lynch | 40/525 |
| 1,686,994 | 10/1928 | Thompson | 40/526 |
| 1,755,753 | 4/1930 | Voss | 40/526 |
| 2,181,104 | 11/1939 | Moorhouse | 40/526 |
| 2,546,236 | 3/1951 | Pflueger | 40/472 |
| 3,605,302 | 9/1971 | Müller | 40/526 X |
| 3,616,556 | 11/1971 | Williams | 40/97 |
| 3,849,919 | 11/1974 | Gravelle et al. | 40/472 |
| 5,022,172 | 6/1991 | Kawahara et al. | 40/475 X |

FOREIGN PATENT DOCUMENTS 2044028 4/1975 Fed. Rep. of Germany .

63-316293 12/1988 Japan .

*Primary Examiner*—Kenneth J. Dorner
*Assistant Examiner*—Milton Nelson, Jr.
*Attorney, Agent, or Firm*—Birch, Stewart, Kolasch & Birch

[57] ABSTRACT

The display apparatus has an endless drive member wound on drive sprockets and driven sprockets so that the drive member travels along a circulating travel path. An array of display plates is attached to a specified region of the endless drive member in such a manner that each of the display plates can be swiveled. First, when the display plates are located at the front part of the path, an advertising sign on their front surfaces is shown. As the display plates move, driven by the drive member, and pass the left end of the circulating path, they are guided by a first guide member in such a way that they maintain the same attitude. When they enter the rear part of the circulating path, an unobstructed view of an advertising sign on a stationary display board installed inside the endless drive member is obtained. As the drive member is driven again to move the display plates past the right end of the circulating path, the display plates are guided by a second guide member to swivel a half turn, showing their back surfaces. When the display plates are located at the front part of the path again, the sign on their back advertising surfaces is shown. In this way, an unobstructed view of three different advertising signs is obtained one after another during one complete turn of the endless drive member.

4 Claims, 6 Drawing Sheets

DISPLAY APPARATUS

This application is a continuation, of application Ser. No. 07/653,519 filed on Feb. 11, 1991, and abandoned on May 18, 1992.

BACKGROUND OF THE INVENTION

Field of the Invention

The present invention relates to a display apparatus which is installed, for example, in a display chamber of vending machines and is capable of multiple display.

It is desired that the display apparatus installed in the display chamber of vending machines change its advertising sign over time to provide effective advertisement of goods or to show a number of goods successively.

A display apparatus currently available that meets the above requirements is disclosed in the Japanese Patent Preliminary Publication No. Showa 63-316293.

In this display apparatus, a plurality of display plates are arranged in front of a fixed display board in such a manner that they are each pivotable 180 degrees about shafts provided at the upper and lower ends thereof. When the display plates rotate and stop at one rotation limit position, an advertising sign on the front surfaces of the display plates is shown. When the display plates rotate in the reverse direction and reach the opposite rotation limit position, another advertising sign on the back of the display plates is shown. When the display plates rotate halfway and stop at the middle between the two rotation limit positions, the display plates are directed parallel to the line of sight of a person looking at the display apparatus, so that the signboard behind the display apparatus can be seen through. Therefore, this display apparatus can show three kinds of advertising signs.

This apparatus, however, has the following drawbacks:

(1) When the display plates are directed almost parallel to the line of sight of a person looking at the display apparatus, the signboard or display board behind can be seen. But, since the display board is covered or masked to the extent of the thickness of the display plates, a clear vision of the display board is not obtained; and (2) The signboard is covered at its front by the display plates and is fitted at the top with a support member that rotatably supports the shafts of the display plates. This construction makes it difficult to replace the signboard behind the display plates.

SUMMARY OF THE INVENTION

This invention has been accomplished to eliminate the above-mentioned drawback and its objective is to provide a display apparatus in which each of the display plates is easy to see, in which a part of the display plates can be replaced with ease, and in which three or more advertising signs can be displayed, offering a multi-sign display capability.

To achieve the above objectives, a display apparatus according to this invention comprises: a drive shaft having a drive wheel secured thereto; a driven shaft having a driven wheel secured thereto; an endless drive member rotatably wound on the drive wheel and the driven wheel; a plurality of display plates, each consisting of a plate-like panel portion having display surfaces on the front and back thereof and shaft portions provided at the upper and lower ends of the panel portion and rotatably supported by the drive member, the display plates being arranged in a specified region on the drive member; first and second projections projecting from the shaft portions of the display plates; a first guide member provided at either end of a circulating path of the drive member, the first guide member having cams that guide the first and second projections in such a way as to prevent them from turning; a second guide member provided at the other end of the circulating path of the drive member, the second guide member having a cam that guides and rotates the second projections a half turn; and a stationary display board installed inside the circulating path of the drive member.

Instead of using the stationary display board installed inside the circulating path of the drive member, the plurality of display plates may be divided into two groups, with these groups of display plates arranged on opposing regions of the drive member.

The display apparatus of the above construction works as follows.

As the endless drive member is driven, the plurality of display plates arranged on the specified region of the drive member are also driven. When the display plates are stopped in front of the stationary display board, the advertising sign on the front of the display plates is shown.

Next, the drive member is driven again. When the display plates move past a first guide member located at one end of the circulating path of the drive member, they are not rotated but kept facing in the same direction. Thus, the display plates, after having passed the first guide member, enter the rear part of the circulating path of the drive member, with their front surfaces facing toward the inside of the circulating path. In this condition, the advertising sign on the stationary display board is shown.

Further, when the display plates move past the other end of the circulating path of the drive member, they are rotated a half-turn by a second guide member so that the front surfaces of the display plates continue to face toward the inside of the circulating path. Therefore, when the display plates are stopped again in front of the stationary display board, the back surfaces of the display plates are shown. In this way, while the drive member is rotated a complete turn, three kinds of advertising signs are displayed.

The stationary display board installed inside the drive member can easily be replaced from above as there is no obstruction hindering the upward movement of the board.

In the display apparatus in which the stationary display board is eliminated and the plurality of display plates are divided into two groups that are arranged on two opposing regions of the drive member, since the two groups of display plates are alternately stopped in the front part of the circulating path for each half-turn of the drive member, four kinds of advertising signs are shown during one and a half turns of the drive member.

BRIEF DESCRIPTION OF THE DRAWINGS

FIGS. 1 through 6 represent embodiments of this invention; of which

FIG. 1 is a perspective view showing the outline of a display apparatus as a first embodiment of this invention;

FIG. 2 is an elevational view of a drive system that rotates a drive member;

FIG. 3 is a plan view showing the outline of the display apparatus;

FIG. 4 is a perspective view showing the display apparatus when display plates are moving past a first guide member;

FIG. 5 is a perspective view showing the display apparatus when display plates are moving past a second guide member; and FIG. 6 is a plan view showing the outline of a display apparatus as a second embodiment of the invention.

DETAILED DESCRIPTION OF THE PREFERRED EMBODIMENT

Embodiments of this invention will be described by referring to the accompanying drawings.

Figure 1:
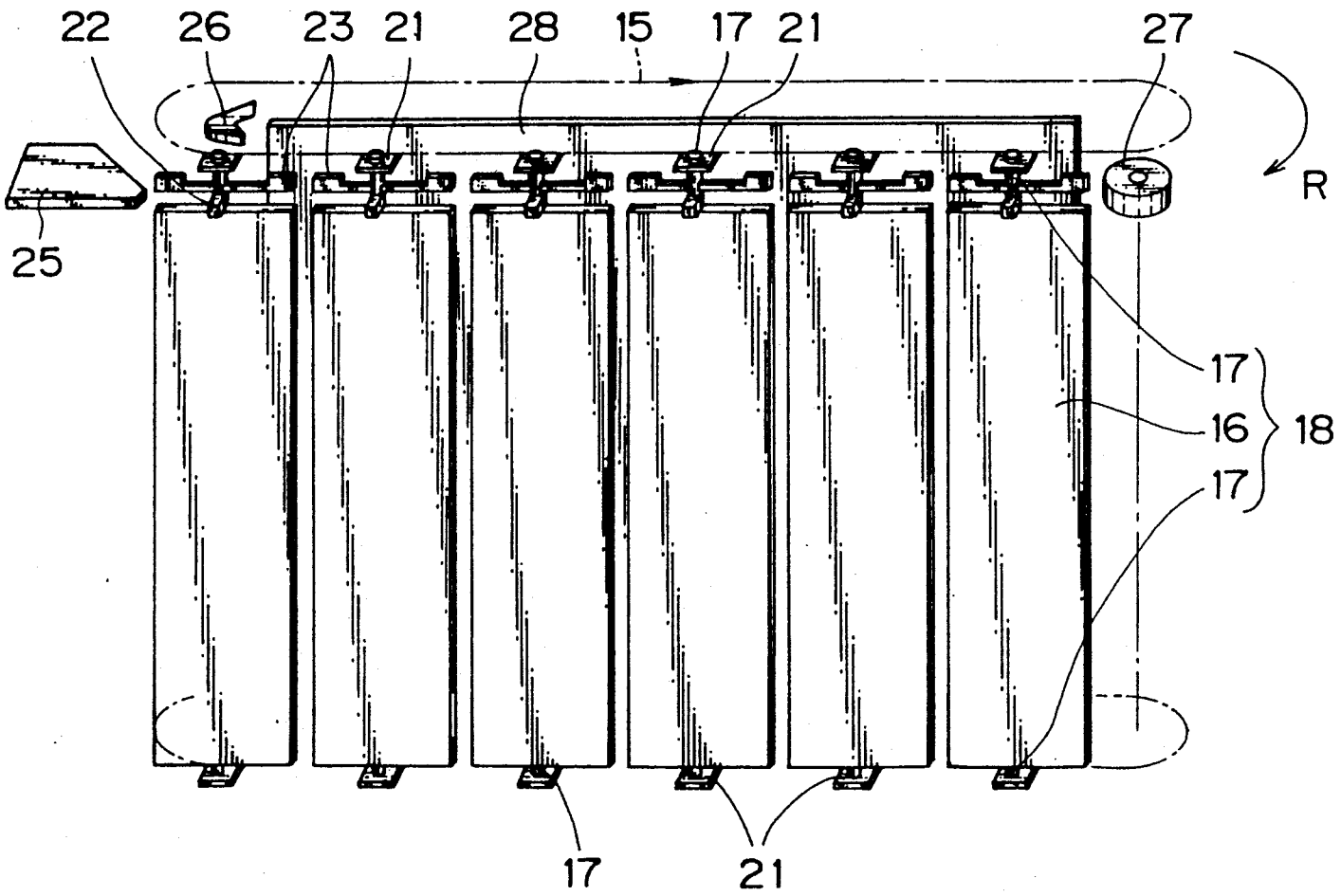
Figure 2:
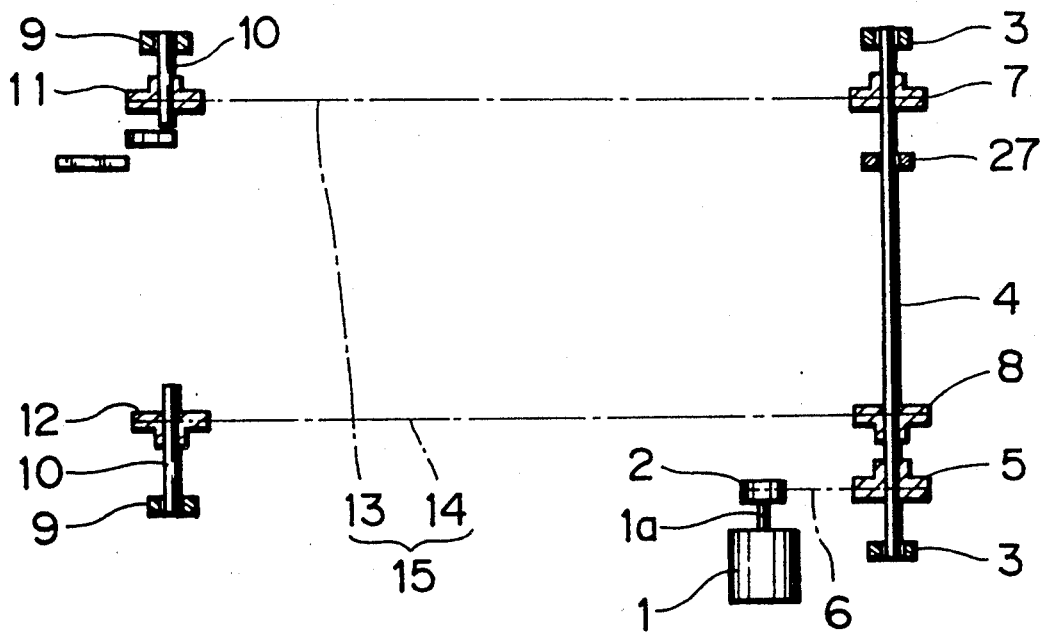

FIG. 1 is a perspective view showing the outline of a display apparatus; FIG. 2 is an elevational view of a drive system that powers a drive member; and FIG. 3 is a plan view showing the outline of the display apparatus.

In FIG. 2, an output shaft 1*a* of a drive motor 1 is securely fitted with a sprocket 2. A drive shaft 4 which is supported at its ends by two bearings 3, 3 is securely fitted with a sprocket 5. A chain 6 is wound on the sprocket 2 and the sprocket 5.

The drive shaft 4 has drive wheels 7 and 8 securely attached to the upper and lower parts thereof, the drive wheels 7, 8 being formed as a sprocket. A driven shaft 10 supported by two bearings 9, 9 is disposed parallel to the drive shaft 4 and has driven wheels 11, 12 securely fitted thereto, the driven wheels 11, 12 being formed as sprockets. An endless chain 13 is wound on and extended between the drive wheel 7 and the driven wheel 11 and another endless chain 14 is wound on the drive wheel 8 and the driven wheel 12. Chains 13 and 14, drive wheels 7 and 8, and driven wheels 11 and 12 form drive member 15 which comprises a pair of elongated oval travel paths for display plates 18. Each travel path is composed of two straight portions, located between each pair of drive and driven wheels (7,11 and 8,12), and two semi-circular portions, located around the outside half of the perimeter of each drive and driven wheel.

Figure 3:
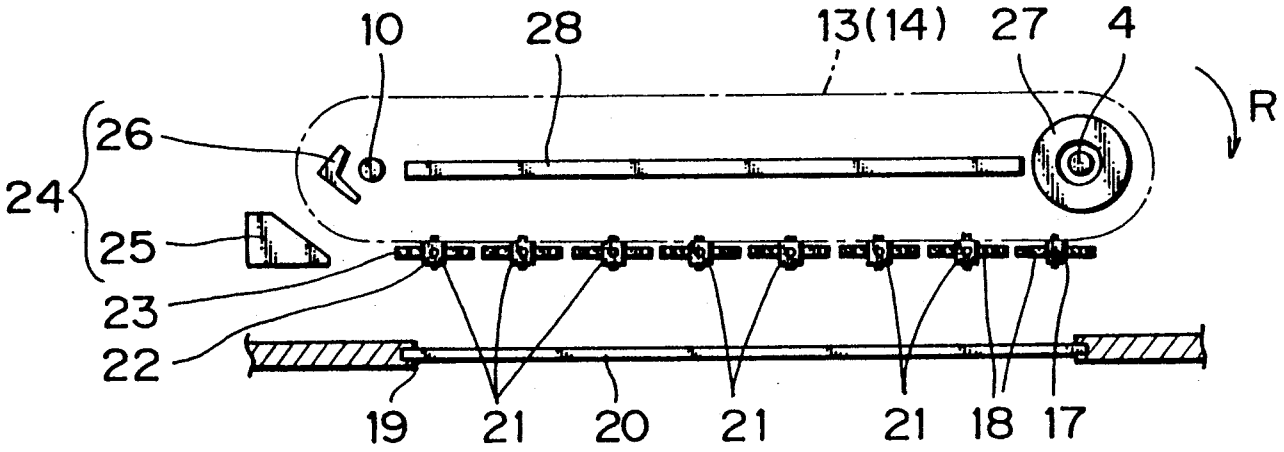

As the drive motor 1 rotates in the forward direction, the drive shaft 4 is rotated in the direction of arrow R in FIG. 3 causing a drive member 15 made up of two endless chains 13, 14 to rotate in the same direction R.

As shown in FIG. 1, each of display plates 18 is comprised of: a panel portion 16 formed of a rectangular plate material and having display surfaces at the front and the back to show advertising signs; and shaft portions 17 provided to the upper and lower ends of the panel portion 16.

As shown in FIG. 3, a display window 19 is provided in front of the drive member 15 and is provided with a transparent panel 20. Over a specified area of the drive member 15 (almost equal to the width of the display window 19), the two endless chains 13, 14 making up the drive member 15 are provided with a plurality of support pieces 21 that project from the side thereof. The support pieces 21 are each formed with a hole, in which the shaft portion 17 of each display plate 18 is rotatably supported.

In this specified area of the drive member 15 a plurality of display plates 18 are arranged side by side with little gap between them.

The shaft portion 17 has a first projection 22 that projects almost perpendicular to the panel portion 16 and a second projection 23 that projects almost parallel to the panel portion 16 (see FIG. 1). First and second projections 22 and 23 form a cross-shaped configuration.

A first guide member 24 (see FIG. 3) is provided on the left side of the circulating travel path of the drive member 15. The first guide member 24 consists of: a first cam 25 that is located outside the circulating path of the drive member 15 to guide the first projections 22 of the shaft portions 17; and a second cam 26 that is located inside the circulating path of the drive member 15 to guide the second projections 23 of the shaft portions 17. Since the first guide member 24 guides the first projections 22 and the second projections 23 in such a way as to prevent them from turning, the display plates 18 are kept in the same attitude while passing the left end of the circulating path of the drive member 15.

At the right end of the circulating path of the drive member 15 there is provided a second guide member 27. The second guide member 27 consists of a disc-shaped cam installed inside the circulating path of the drive member 15. The second projection 23 is guided by the second guide member 27 to rotate a half turn, so that when the display plate 18 moves past the right end of the circulating path of the drive member 15, the display plate 18 is swiveled to show the back of the panel portion 16.

Inside the drive member 15 is installed a stationary display board 28. The stationary display board 28 can be mounted and dismounted by making use of a space above the drive member 15.

Now, the operation of the display apparatus of the above construction will be explained.

As shown in FIGS. 1 and 3, when the display plates 18 stop at the front part of the circulating path close to the transparent panel 20, an advertising sign on the front of each display plate 18 can be seen through the transparent panel 20.

Figure 4:
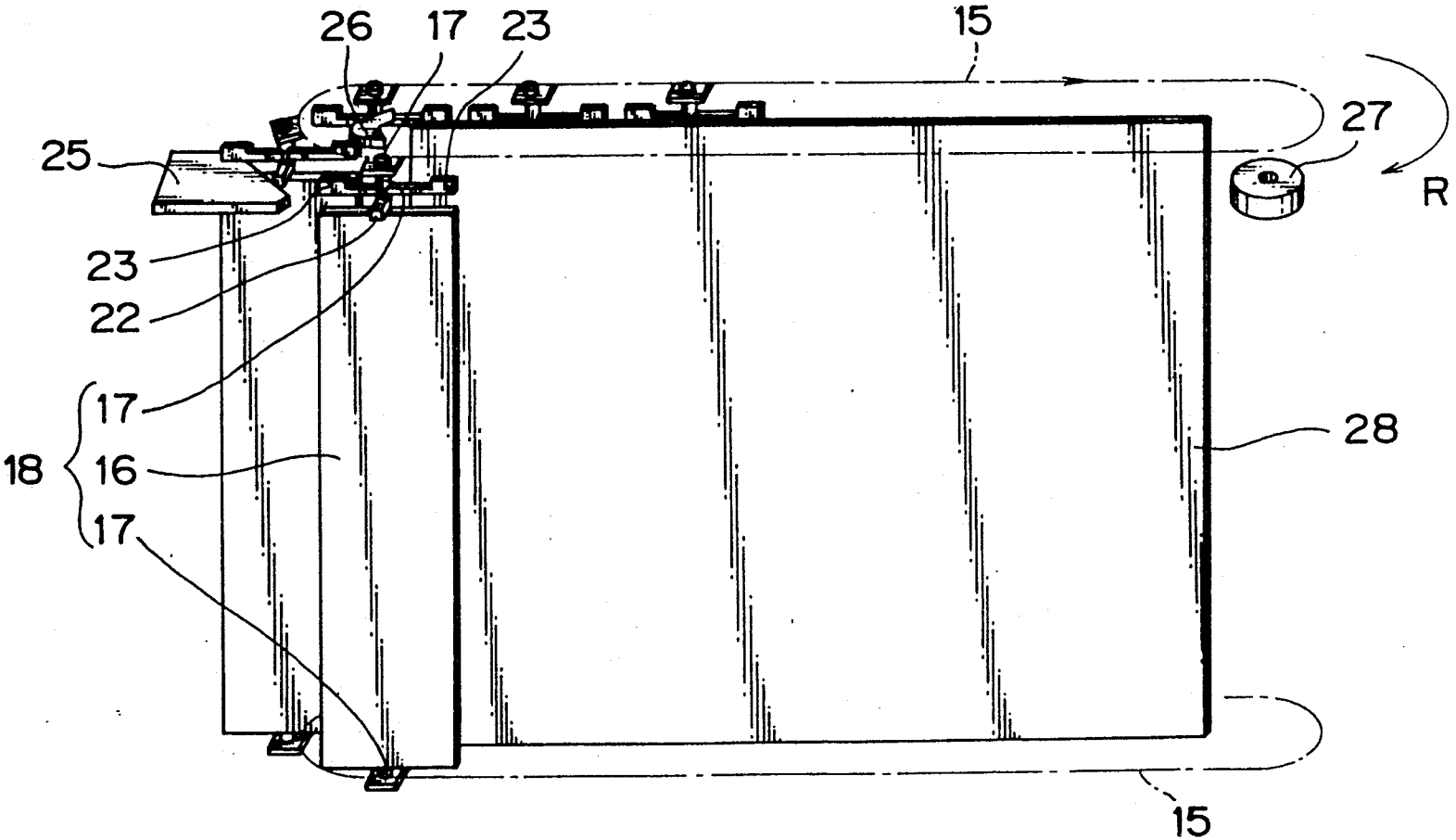
Figure 5:
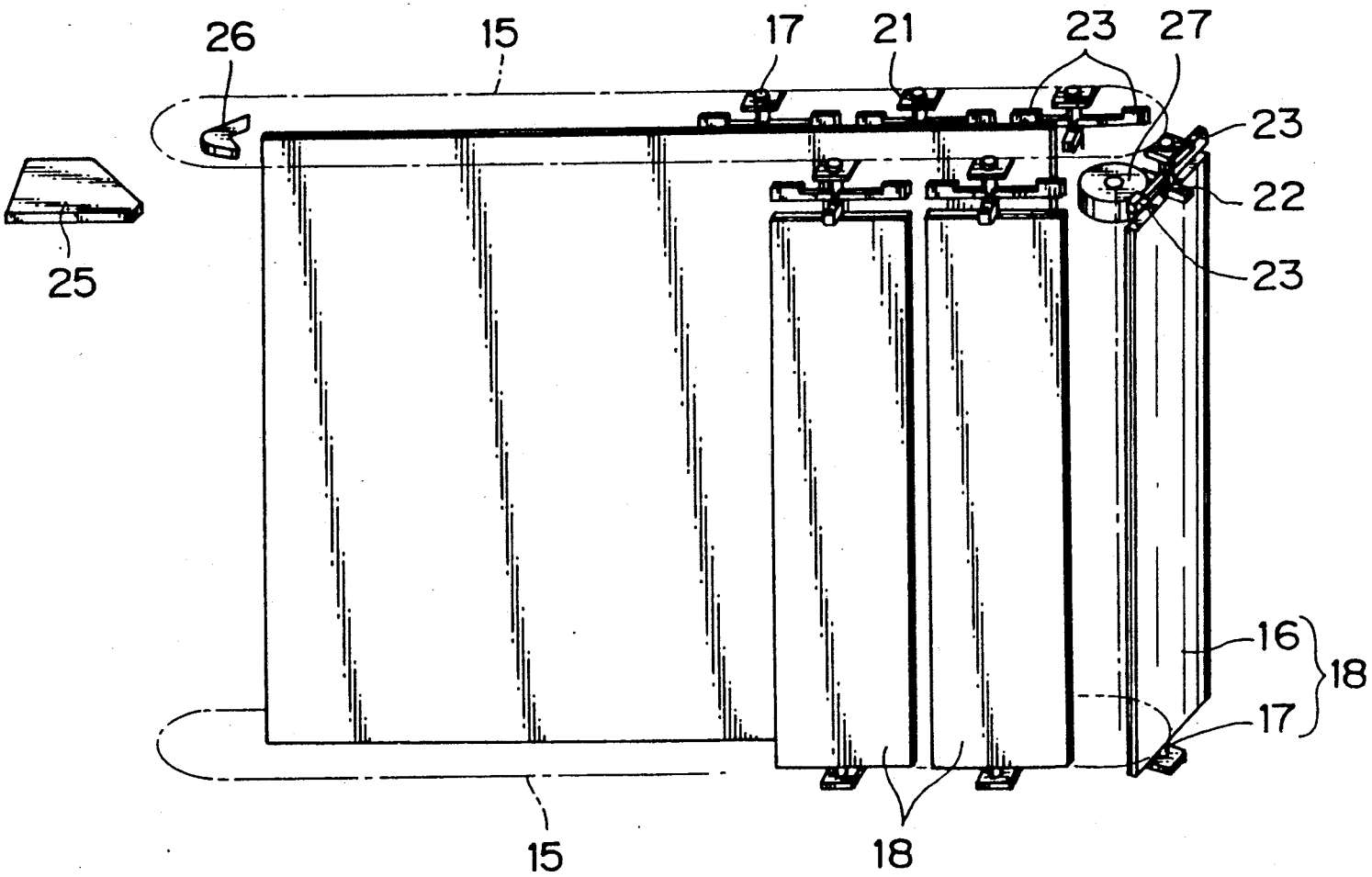

Next, as the drive member 15 is driven in the direction of arrow R, the display plates 18 move past the left end of the drive member 15. Since the first and second projections 22 and 23 are guided by the first guide member 24 as mentioned earlier, the front surface of each display plate 18 faces toward the inside of the drive member 15 (see FIG. 4).

When all the display plates 18 have passed the left end of the drive member 15, the drive member 15 is stopped. Now, an advertising sign on the stationary display board 28 can be seen through the transparent panel 20.

Then, the drive member 15 is again driven in the direction of arrow R. When the display plates 18 pass the right end of the drive member 15, each of the second projections 23 is guided by the second guide member 27 to rotate a half turn, so that when the display plates 18 stop at the front part of the circulating path close to the transparent panel 20, another advertising sign at the back of the display panels 18 can be seen through the transparent panel 20.

In this way, three kinds of advertising signs are displayed successively over time. Because the stationary display board 28 can easily be dismounted, the advertising effect can be enhanced by replacing, as required, the existing display board 28 with another board 28 having a desired advertising sign.

Figure 6:
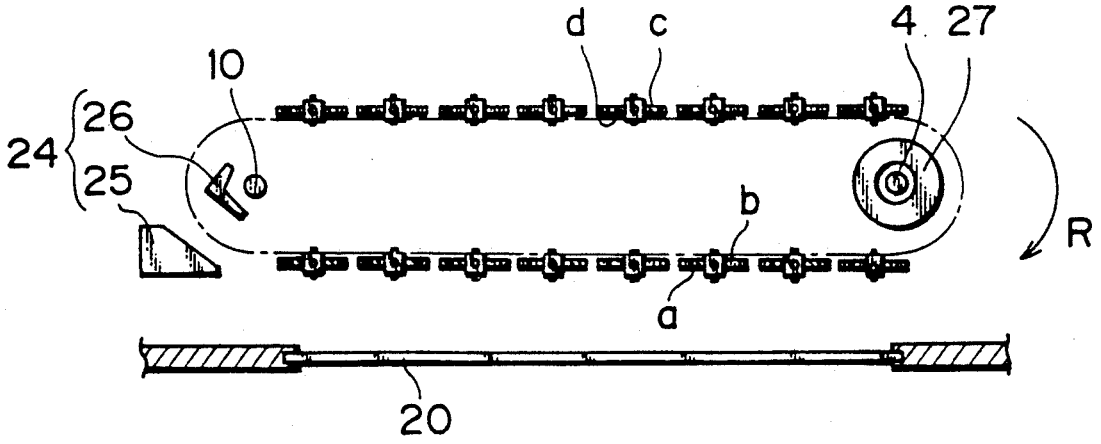

FIG. 6 is a plan view showing the outline of a second embodiment of this invention, in which two groups of display plates 18 are mounted on two opposing regions of the drive member 15, with the stationary display board 28 removed. In other respects, this second embodiment is similar to the first embodiment.

In FIG. 6, the front and back of each display plate 18 of the first group located at the front part of the circulating path are designated a and b. Also, the front and back of each display plate 18 of the second group located at the rear part of the circulating path are designated c and d. Each time the drive member 15 is driven a half-turn in the direction of arrow R and stopped, the advertising sign shown on the display apparatus changes from one of the four kinds of advertising signs (on the front a of the first group of display plates 18, on the front c of the second group, on the back b of the first group and on the back d of the second group) to the next, thus showing a variety of advertising signs over time. This enhances the effect of advertisement.

Advantages of the Invention

With the above-mentioned construction, this invention offers the following advantages.

(1) Since there is no obstruction in front of the display plates, a clear view of the advertising sign is obtained.

(2) The display apparatus has a structure that allow easy replacement of the stationary display board, which in turn permits multiple advertising signs to be displayed.

(3) When two groups of display plates are attached to the opposing regions of the drive member, four kinds of advertising signs can be displayed.

These advantages all contribute to enhancing the advertising effect.

What is claimed is:

1. A display apparatus comprising:

a drive shaft having a drive wheel secured thereto;

a driven shaft having a driven wheel secured thereto;

an endless drive member rotatably wound on said drive wheel and said driven wheel, thereby forming an elongated oval travel path comprising two straight portions and two semicircular portions;

a plurality of display plates, each display plate comprising a plate-like panel portion having a front surface and a back surface, display surfaces on said front and back surfaces thereof, and shaft portions provided at upper and lower ends of said panel portion, said shaft portions being rotatably supported by said drive member, said display plates being divided in two groups that are positioned at two opposing regions of said drive member;

a display window, said plurality of display plates being viewed through said display window;

first and second projections projecting from said shaft portions of the display plates;

a first guide member provided in one semicircular portion of said elongated oval travel path of said drive member, said first guide member having cams that guide said first and second projections in such a way as to prevent said first and second projections from rotating in said semicircular portion of said elongated oval travel path relative to said display window; and a second guide member provided in a second semicircular portion of said elongated oval travel path of the drive member, said second guide member having a cam that guides said second projections and causes said second projections to rotate a half turn in said second semicircular portion of said elongated travel path relative to said display window.

2. The display apparatus of claim 1, wherein said first and second projections form a cross-shaped configuration.

3. A display apparatus comprising:

a drive shaft having a drive wheel secured thereto;

a driven shaft having a driven wheel secured thereto;

an endless drive member rotatably wound on said drive wheel and said driven wheel, thereby forming an elongated oval travel path comprising two straight portions and two semicircular portions;

a plurality of display plates, each display plate comprising a plate-like panel portion having a front surface and a back surface, display surfaces on said front and back surfaces thereof, and shaft portions provided at upper and lower ends of said panel portion, said shaft portions being rotatably supported by said dive member, said display plates being arranged in a specified region on said drive member;

a display window, said plurality of display plates being viewed through said display window;

first and second projections projecting from said shaft portions of the display plates;

a first guide member provided in one semicircular portion of said elongated oval travel path of said drive member, said first guide member having cams that guide said first and second projections in such a way as to prevent said first and second projections from rotating in said semicircular portion of said elongated oval travel path relative to said display window;

a second guide member provided in a second semicircular portion of said elongated oval travel path of the drive member, said second guide member having a cam that guides said second projections and causes said second projections to rotate a half turn in said second semicircular portion of said elongated travel path relative to said display window; and a stationary display board installed inside said circulating path of the drive member.

4. The display apparatus of claim 3, wherein said first and second projections form a cross-shaped configuration.

* * * * *